US006439395B1

(12) United States Patent
Voellmer et al.

(10) Patent No.: US 6,439,395 B1
(45) Date of Patent: Aug. 27, 2002

(54) APPARATUS FOR SORTING SHEETLIKE DATA CARRIERS, SAID APPARATUS COMPRISING A LONGITUDINAL/CROSS CONVEYING DEVICE

(75) Inventors: Christian Voellmer, Munich; August Hausler, Wolfratshausen; Erwin Demmeler, Memmingen, all of (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/623,470

(22) PCT Filed: Mar. 12, 1999

(86) PCT No.: PCT/EP99/01637

§ 371 (c)(1),
(2), (4) Date: Nov. 24, 2000

(87) PCT Pub. No.: WO99/48060

PCT Pub. Date: Sep. 23, 1999

(30) Foreign Application Priority Data

Mar. 13, 1998 (DE) ..... 198 10 928

(51) Int. Cl.[7] ..... B07C 5/342; B65H 29/60; B65H 29/62

(52) U.S. Cl. ..... 209/534; 271/184; 271/225

(58) Field of Search ..... 209/534; 271/184, 271/225

(56) References Cited

U.S. PATENT DOCUMENTS

| | | | | | |
|---|---|---|---|---|---|
| 2,827,167 | A | * | 3/1958 | Joseph et al. | 209/534 |
| 3,976,198 | A | * | 8/1976 | Carnes, Jr. et al. | 209/111.7 T |
| 4,236,639 | A | * | 12/1980 | Boettge et al. | 209/534 |
| 4,571,489 | A | * | 2/1986 | Watanabe | 235/379 |
| 4,573,848 | A | * | 3/1986 | Lundblad | 414/104 |
| 4,733,857 | A | * | 3/1988 | Feldeisan et al. | 271/296 |
| 4,757,903 | A | * | 7/1988 | Edin | 209/534 |
| 4,787,518 | A | * | 11/1988 | Yuge et al. | 209/534 |
| 4,830,742 | A | * | 5/1989 | Takesako | 209/534 |
| 4,856,768 | A | * | 8/1989 | Hiroki et al. | 271/186 |
| 5,131,645 | A | * | 7/1992 | Ricciardi | 271/181 |
| 5,354,047 | A | * | 10/1994 | Chestnutt et al. | 271/195 |
| 5,394,992 | A | * | 3/1995 | Winkler | 209/552 |
| 5,485,989 | A | * | 1/1996 | McCay et al. | 271/2 |
| 5,555,983 | A | * | 9/1996 | Yamagishi | 209/534 |
| 5,617,956 | A | * | 4/1997 | Werner et al. | 209/534 |
| 5,917,930 | A | * | 6/1999 | Kayani et al. | 382/135 |
| 5,938,044 | A | * | 8/1999 | Weggesser | 209/534 |
| 6,296,242 | B1 | * | 10/2001 | Saltsov et al. | 271/3.21 |
| 6,311,819 | B1 | * | 11/2001 | Stromme et al. | 209/534 |

FOREIGN PATENT DOCUMENTS

| | | | | |
|---|---|---|---|---|
| DE | 3333365 A1 | * | 3/1984 | 209/534 |
| EP | 0264125 A1 | * | 4/1988 | G07D/7/00 |
| GB | 2111956 A | * | 7/1983 | 209/534 |
| GB | 2127792 A | * | 4/1984 | 209/534 |
| JP | 52-69695 | * | 6/1977 | 209/534 |
| JP | 62-275966 | * | 11/1987 | 271/184 |

* cited by examiner

*Primary Examiner*—Donald P. Walsh
*Assistant Examiner*—Daniel K Schlak
(74) *Attorney, Agent, or Firm*—Bacon & Thomas, PLLC

(57) ABSTRACT

To provide an apparatus for sorting sheetlike data carriers which firstly has a compact and ergonomically optimal design and secondly permits the use of compact and cost-effective test devices, it is proposed that the input pocket (2) and the output pocket (12–15) are designed and oriented with respect to the front side (1) of the apparatus such that the long sides of the data carriers (3) face the operator. The singling device (19) and the transport system (4) transport the data carriers through a test device in the direction of their long sides. After running through the test device (6) the data carriers are supplied to one of the output pockets (12–15) by a longitudinal/cross conveying device (7) along their transverse sides.

15 Claims, 2 Drawing Sheets

APPARATUS FOR SORTING SHEETLIKE DATA CARRIERS, SAID APPARATUS COMPRISING A LONGITUDINAL/CROSS CONVEYING DEVICE

BACKGROUND OF THE INVENTION

This invention relates to an apparatus for sorting sheetlike data carriers, in particular bank notes.

DE-A 33 33 365 discloses a sorting apparatus with a bank note input pocket which faces the operator and into which bank notes with a rectangular format having narrow and longer dimensions are fed such that the longer dimension of the bank notes faces the operator and extends parallel to the front panel of the apparatus. The bank notes are singled from the input pocket and supplied successively by means of a transport system to a test device which determines the face value and state of the bank notes, among other things. In accordance with this test, the individual bank notes are then supplied to corresponding output pockets. The input and output pockets of the known apparatus are disposed in a descending array and located close together. Due to this and the orientation of the bank notes both in the input pocket and in the output pockets along their longer dimension parallel to the front panel of the apparatus so that the bank notes are easily grasped by the operator, the known sorting apparatus possesses improved ergonomic design.

In the known apparatus, the bank notes are transported from the input pocket to the output pockets with the narrow dimension of the bank notes leading. This necessitates accordingly large-volume and thus elaborate test devices because transverse scanning of the bank notes requires considerably more measuring tracks for large-surface or informative assessment of the bank note than testing the bank notes when the bank notes are transported with the longer dimension leading. For example, one can test security threads or other elements such as adhesive strips extending transversely to the bank note with much lower effort when the longer dimension is leading.

The invention is therefore based on the problem of proposing a generic apparatus not only having a compact construction and optimal ergonomic design of the apparatus, but also permitting the use of compact and thus cost-effective test devices.

This problem is solved according to the invention by the characterizing features of the present invention. A method for sorting sheetlike data carriers is an object of the present invention.

The inventive solution is characterized in that the bank notes face the operator along their longer dimension both in the input pocket and in the output pockets but are singled in the direction with the narrow dimension leading and also transported through the test device in this orientation. After testing, the bank notes are oriented in a longitudinal/cross conveying device so as to be supplied to the output pockets in the direction with the longer dimension leading.

Cross removal of the bank notes with a longitudinal/cross conveying apparatus furthermore offers the possibility of alignment along the longer and narrow dimensions of a bank note stack in the output pocket thereby ensuring flush-edge stacking along the longer and narrow dimensions.

Since the bank notes face the operator along their longer dimension both in the input pocket and in the output pockets, the corresponding stacks can be grasped conveniently and reliably. Moreover, the testing of the bank notes can be performed by means of cost-effective and compactly constructed test devices.

The invention thus permits a sorting apparatus not only having an especially good ergonomic design but also permitting the use of compact, cost-effective assemblies especially with respect to testing.

According to a preferred embodiment of the invention, the input pocket and output pockets are disposed close together within an operator's reach or grasp, resulting in optimal ease of operation of the sorting apparatus. Moreover, the stated pockets are easy to inspect.

To permit bank notes which the test device detects as being suspected forgeries or unidentifiable to be sorted out separately as early as possible, a further advantageous embodiment of the invention has a separate output pocket provided between the test device and the longitudinal/cross conveying device. Since the bank notes collected in this pocket require manual reworking by the operator, it is especially advantageous from an ergonomic point of view that this output pocket is also disposed in the immediate vicinity of the input pocket and is likewise easy to inspect.

According to a further embodiment of the invention, one or more output pockets and the longitudinal/cross conveying device are parts of a modularly constructed unit. This output module is equipped with standardized interfaces for receiving and passing on longitudinally transported bank notes. Via the longitudinal/cross conveying device integrated into the output module the bank notes are transferred out of the longitudinal conveying path if required and supplied to the output pockets in the direction of the longer dimension leading. Accordingly adapted electric and mechanical interfaces make it possible in a simple way to connect the output module to a basic module including the input pocket a singling device, a part of the transport system, the test device and optionally an output pocket for rejected bank notes. Depending on the requirements and use of the sorting apparatus, one can also interconnect a plurality of output modules so that different configurations of the total system can be realized.

BRIEF DESCRIPTION OF THE DRAWINGS

Further advantageous features as well as the structure and function of the invention will result from the following description referring to the drawing, in which.

DETAILED DESCRIPTION OF THE INVENTION

The invention will be explained in the following by the example of a bank note sorting apparatus; the same reference signs are selected for matching parts.

Figure 1:
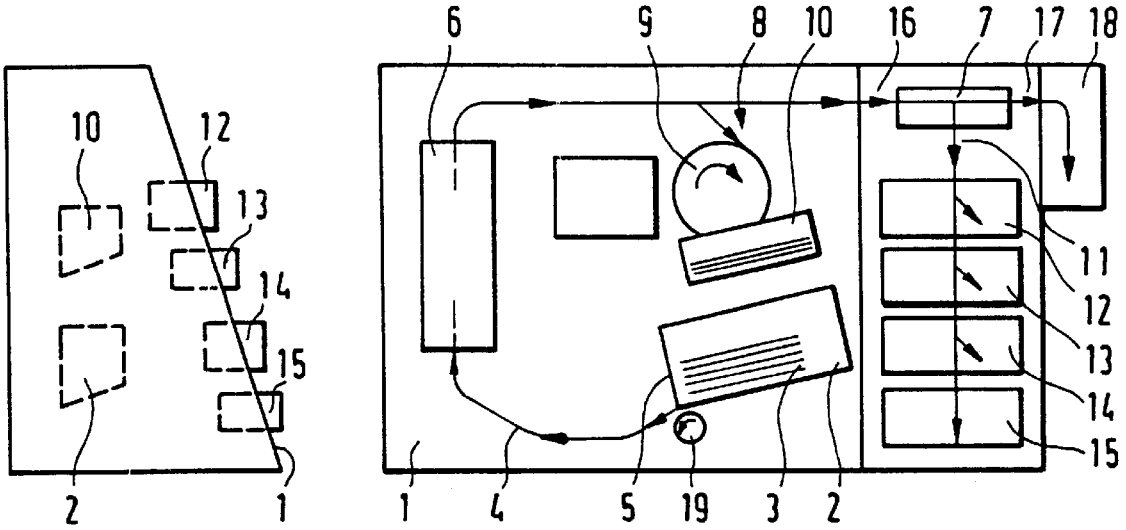
FIG. 1 shows a first embodiment.

FIG. 1 shows front and side views of a sorting apparatus formed as a desktop machine. The figure only shows the components essential for understanding the invention, which are shown in greatly schematized form. Front panel 1 of the apparatus inclined to the horizontal at an angle of about 70° has input pocket 2 into which a stack of bank notes 3 can be inserted. The inclination is provided with respect to the operator such that the upper end of the front panel is directed away from the operator. The notes face the operator along their longer dimension and are inserted into input pocket 2 parallel to the front panel. The notes are singled from the input pocket in the direction of their longer dimension with their narrow dimension leading along the transport path by suitable singling device 19 and delivered to following transport system 4. Transport system 4 extends along a substantially U-shaped path in the area of the lower, side and upper limiting walls of the housing. This permits a sufficiently long transport path to be accommodated in a relatively small space. This length is firstly necessary to accommodate a suitable number of sensors in the test device, secondly transport path or transport time is required to evaluate the test signals and activate suitable control elements. The provided path of transport system 4 makes it very accessible, in particular in the area of test device 6. Subsequently the notes are transported through test device 6 for checking selectable criteria of the note. In accordance with this test the notes are subsequently supplied either via so-called spiral pocket stacker 9 to reject pocket 10 or via longitudinal/cross conveying device 7 to output pockets 12 to 15. Reject pocket 10 disposed in the immediate vicinity of the input pocket is intended for unidentifiable or suspected counterfeit notes which must be subjected to a check by the operator. Output pockets 12 to 15 are also disposed in the immediate vicinity of the input pocket and thus within the operator's reach. The notes face the operator with their longer dimension in the input pocket, the output pockets and reject pocket 10 for unidentifiable and/or suspected counterfeit notes, so that they can be grasped conveniently and reliably by the operator.

Since output pockets 12–15 are combined laterally of input pocket 2, and reject pocket 10 is disposed above input pocket 2, the danger of confusion between reject pocket 10 and output pockets 12–15 is eliminated despite the altogether close arrangement of the pockets.

Specifically, the apparatus works as follows. Bank notes 3 deposited against stop face 5 in input pocket 2 are supplied to transport system 4 consecutively note by note by means of singling device 19. The bottom of the input pocket is inclined downgrade by about 20° to the left and back so that the notes are aligned both on a long side and on a short side. Transport system 4 conveys the notes with the narrow dimension of the bank notes leading, guiding them through test device 6 which performs a check by suitable sensors during transport. The output signals of the sensors are supplied to a control device not shown in the figures. Said control device decides in which output pocket the particular notes should be deposited.

Unidentifiable multiple removals and suspected counterfeits are transferred out of transport system 4 by switch 8 and fed to spiral pocket stacker 9. The latter has a drum shape and fan-shaped receptacles and is driven to rotate as indicated by the arrow. Notes entering the stacker are slowed down therein and then placed in reject pocket 10 for rejected notes. The notes here are available to the operator for reworking.

The other notes are supplied to longitudinal/cross conveying device 7 where they change their original moving direction along their long sides to a moving direction along the narrow dimension of the bank note with the longer dimension leading through a corresponding mechanism if they are to be deposited in output pockets 12–15. They are then passed on to transport system 11 which supplies them to one of output pockets 12 to 15 in accordance with selectable sorting criteria. For this purpose they are transferred out by suitable switches (not shown) and deposited via stackers (also not shown). Said stackers differ from above-described stacker 9 only in that the notes are supplied in the direction of the longer dimension leading, permitting the stackers to have a much smaller diameter. This permits output pockets 12 to 15 to be set in a row in especially compact fashion. By reason of the inclined front panel said output pockets are disposed in the manner of stairs and thus especially easy to operate.

When the notes are placed in the reject pocket 10 the order of sheets from the input pocket is retained. This permits the use of so-called separating cards as intermediate layers between individual processing units.

Should a breakdown lead to failure of the control device, for example, so that proper deposit of the notes in the right output pocket is no longer ensured, said notes are supplied via output 17 to emergency output pocket 18. This deposit is effected automatically if there is no cross removal in the direction of cross conveyor 11.

Figure 2:
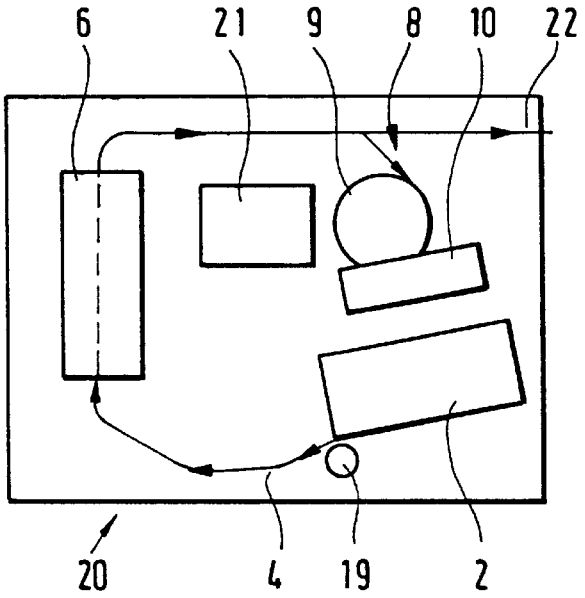
FIG. 2 shows a basic module.
Figure 3:
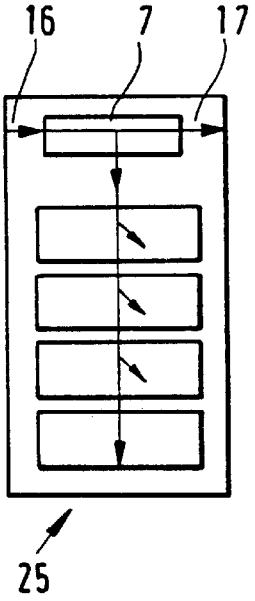
FIG. 3 shows an output module.

As illustrated by FIGS. 2 and 3, the inventive device is of modular design and composed of basic module 20 (FIG. 2) and at least one output module 25 (FIG. 3). Basic module 20, as explained above, contains input pocket 2 with singling device switch 19, transport system 4, test device 6, switch 8, spiral pocket stacker 9 with associated reject pocket 10 for rejected notes, and display 21 for indicating operating conditions, information for the operator or the like. Optionally, basic module 20 can also contain the control device and a data memory unit and an input device for entering data and/or control commands. Moreover, basic module 20 has output 22 for connecting further modules.

Output module 25 shown in FIG. 3 is connectable to basic module 20 such that output 22 of basic module 20 is connected with input 16 of stacker module 25. This obviously also produces an electric connection between the control device and the controllable components of output module 25. Output module 25 contains all required driving and adjusting means for longitudinal/cross conveyor 7, the stackers and the associated switches. Via output 17 one can connect a further identically constructed output module or other output modules with accordingly adapted interfaces. At the end of the total system one always provides emergency output pocket 18 at output 17 of the last module connected to basic module 20.

Figure 4:
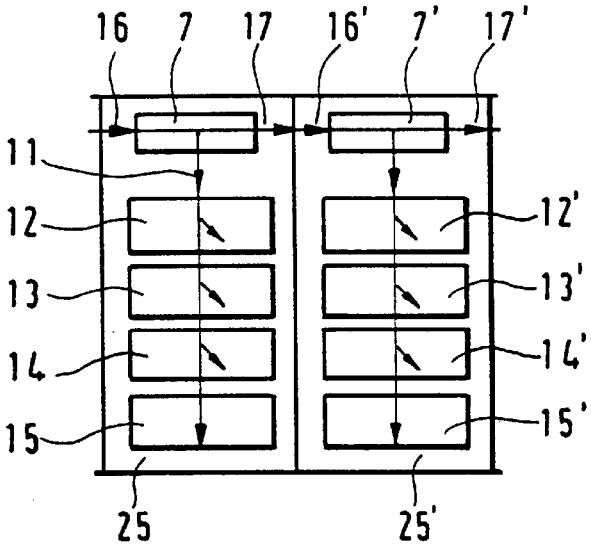
FIG. 4 shows the cooperation of two output modules.

FIG. 4 shows the cooperation of output module 25 with a further identically constructed module. Notes reach longitudinal/cross conveying device 7 via input 17 of output module 25. If a note is to be deposited in one of output pockets 12 to 15, the cross removal is activated in the longitudinal/cross conveying device and the note supplied to one of output pockets 12–15 via transport system 11. If the note is to be deposited in another output pocket it is transported further without cross removal and passed via output 17 of output module 25 to input 16' of following module 25'. In output module 25' either a cross removal for deposit in one of output pockets 12' to 15' can then be effected or the note can be transported further via output 17'.

Figure 5:
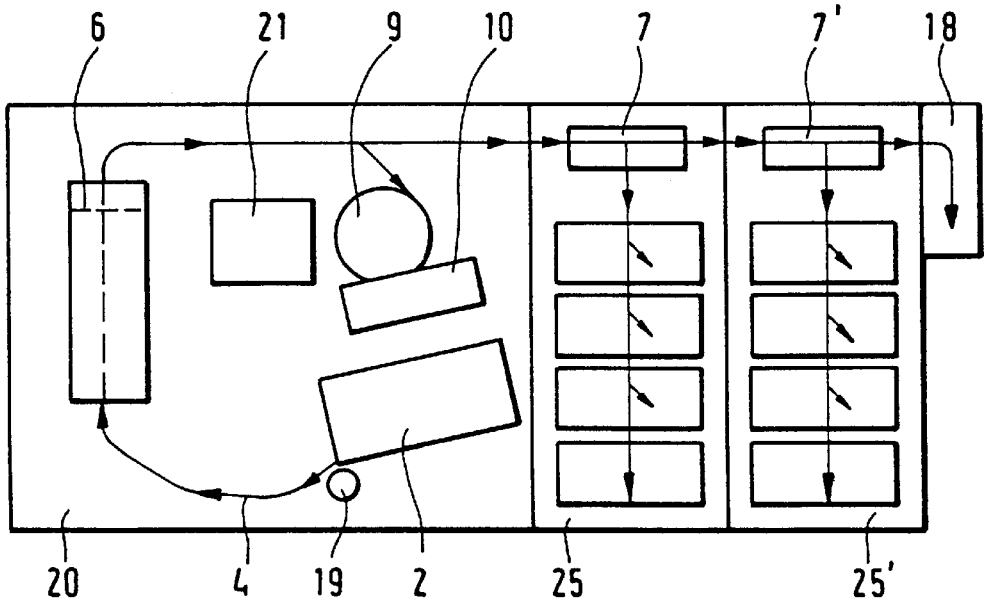
FIG. 5 shows a second embodiment of the invention.

FIG. 5 shows a possible configuration of a bank note sorting apparatus with altogether eight output pockets 12 to 15 and 12' to 15'. This configuration is suitable for example for a sorting mode whereby notes of different denominations and positions are to be deposited in different output pockets.

The configuration shown in FIG. 5 is characterized by a very compact design despite the large number of output pockets. In this configuration input pocket 2, reject pocket 10 for notes requiring reworking, and the other output pockets in output modules 25 and 25' are also disposed in the immediate vicinity of each other and thus within the operator's reach. In all input and output pockets accessible to the operator the notes are disposed with their longer dimension facing the operator and parallel to the front panel of the apparatus. This means that even a machine configuration with a large number of output pockets is characterized by high operating convenience.

What is claimed is:

1. An apparatus for sorting sheet-like data carriers having a narrow dimension and a longer dimension, comprising:

a singling device in communication with an input pocket for singling said data carriers one at a time;

a transport system for transporting said data carriers from said singling device to at least one output pocket;

a test device integrated into the transport system and located between said input pocket and said at least one output pocket; and a longitudinal/cross conveying device positioned between said test device and said at least one output pocket for transporting each of said data carriers from said test device to said at least one output pocket;

wherein the input pocket and the at least one output pocket are dimensioned and configured such that the longer dimension of said data carriers located in said input pocket and said at least one output pocket is generally parallel to a front side of the apparatus;

wherein the singling device and the transport system are configured such that each of said data carriers are transported through the test device in a direction parallel to the longer dimension of the data carriers, and said longitudinal/cross conveying device is arranged to transport each of said data carriers to said at least one output pocket in a direction parallel to the narrow dimension of the data carriers.

2. The apparatus according to claim 1 wherein the input pocket and the at least one output pocket are positioned laterally across from one another along the front side of said apparatus to permit access by an operator.

3. The apparatus according to claim 1 wherein a switch is positioned between the test device and the longitudinal/cross conveying device and arranged to transfer and transport an unidentifiable or suspect counterfeit data carrier to a reject pocket.

4. The apparatus according to claim 3 wherein the reject pocket is positioned along the front side of the apparatus to permit access by an operator.

5. The apparatus according to claim 1 wherein the transport system extends along a generally U-shaped path commencing at the input pocket via the test device and directed towards the longitudinal/cross conveying device.

6. The apparatus according to claim 5 wherein the U-shaped path extends near the periphery of the apparatus.

7. The apparatus according to claim 1 wherein a basic module of the apparatus includes the input pocket, the singling device, the transport system, the test device and a reject pocket.

8. The apparatus according to claim 1 wherein a modularly constructed output unit of the apparatus includes the longitudinal/cross conveying device and the at least one output pocket.

9. The apparatus according to claim 8 wherein the output unit includes standardized input and output devices positioned along mutually opposite sides of said longitudinal/cross conveying device.

10. The apparatus according to claim 9 wherein the longitudinal/cross conveying device transfers the data carriers from the transport system to said at least one output pocket.

11. The apparatus according to claim 1 comprising a plurality of output pockets arranged in a descending array along the face of the apparatus.

12. The apparatus according to claim 11 wherein said plurality of output pockets are positioned below said longitudinal/cross conveying device.

13. The apparatus according to claim 11 wherein the plurality of output pockets are configured in a stair-like pattern.

14. The apparatus according to claim 13 wherein the front side of said apparatus is inclined at an angle about 70°.

15. A method for sorting sheet-like data carriers having a narrow dimension and a longer dimension comprising the steps of:

inserting the data carriers into an input pocket disposed along a front face of said apparatus such that the longer dimension of the data carriers is parallel therewith;

singling each of said data carriers from the input pocket;

transporting each of said data carriers in a direction parallel with said longer dimension of said data carriers with a transport system defining a transport path and passing through a test device;

inspecting each of said data carriers with said test device;

transporting each of said data carriers to a longitudinal/cross conveying device, said longitudinal/cross conveying device transporting said data carriers in a direction parallel to said narrow dimension of said data carriers; and depositing each of said data carriers in at least one output pocket disposed along the front face of the apparatus and positioning said data carriers such that said longer dimension thereof is parallel with the front face of the apparatus.

* * * * *